US009462871B2

(12) United States Patent
Machiorlette et al.

(10) Patent No.: US 9,462,871 B2
(45) Date of Patent: Oct. 11, 2016

(54) APPLICATOR ASSEMBLY

(71) Applicant: Worth Beauty, LLC, Richmond, VA (US)

(72) Inventors: Steven C. Machiorlette, Houston, TX (US); Edward Darrell Jervey, III, Richmond, VA (US); Carol Martin, Atlanta, GA (US)

(73) Assignee: Worth Beauty, LLC, Richmond, VA (US)

( * ) Notice: Subject to any disclaimer, the term of this patent is extended or adjusted under 35 U.S.C. 154(b) by 0 days.

(21) Appl. No.: 13/955,817

(22) Filed: Jul. 31, 2013

(65) Prior Publication Data

US 2014/0034075 A1 Feb. 6, 2014

Related U.S. Application Data

(60) Provisional application No. 61/677,861, filed on Jul. 31, 2012.

(51) Int. Cl.
*A45D 40/26* (2006.01)
*A45D 34/04* (2006.01)

(52) U.S. Cl.
CPC ..... *A45D 40/26* (2013.01); *A45D 34/04* (2013.01)

(58) Field of Classification Search
CPC .. A45D 40/26; A45D 40/262; A45D 40/264; A45D 40/265; A45D 40/28; A45D 34/04; A45D 34/042; A45D 34/043; A45D 34/045; A45D 2200/10; A45D 2200/1009; A61B 17/54; B05B 3/1007; A46B 13/00; A46B 13/001; A46B 13/02; A46B 5/0095; A46B 7/00; A46B 7/04; A46B 7/10; A46B 7/042; A46B 7/044; A46B 7/046; A46B 9/021; A46B 9/023; A46B 2200/1046
USPC ..... 132/200, 218, 119.1, 120, 313, 317, 132/318, 320, 322, 289, 73.5, 73.6, 75.8, 132/333; 15/28, 22.1, 34, 145, 202, 176.1, 15/175, 176.2, 21.1, 22.2; 604/289, 290; 606/131, 271; 401/140, 195, 252–254, 401/6, 24, 25, 118; 607/79, 108–111; 16/422; 403/192, 305, 300, DIG. 4
See application file for complete search history.

(56) References Cited

U.S. PATENT DOCUMENTS 2,032,664 A * 3/1936 Raptis ..... 15/172
2,792,581 A * 5/1957 Woyton ..... 15/144.1

(Continued)

FOREIGN PATENT DOCUMENTS

CH 663148 11/1987
GB 1480265 7/1977

OTHER PUBLICATIONS

International Search Report, dated Oct. 31, 2012, from corresponding International Application Serial No. PCT/US2012/033703.

(Continued)

*Primary Examiner* — Rachel Steitz
(74) *Attorney, Agent, or Firm* — Brient Globerman, LLC

(57) ABSTRACT

An applicator cup for user with a motorized handle for applying cosmetics. The applicator cup includes an applicator configured to apply a liquid or powder substance (e.g., such as cosmetics, makeup, lotion, sunblock, sunscreen, moisturizer, foundation, concealer, eye shadow, blush, bronzer, cream, or any other appropriate substance) to a user's body. The applicator cup may be configured to enable a user to selectively attach the applicator cup to the motorized handle substantially without touching the applicator. The applicator cup is adapted to enable a user to use the applicator cup in combination with a handle, such as a motorized handle, to apply the liquid or powder substances to the user's body.

12 Claims, 8 Drawing Sheets

(56) References Cited

U.S. PATENT DOCUMENTS 3,030,647 A 4/1962 Peyron
3,030,967 A 4/1962 Peyron
3,369,265 A * 2/1968 Halberstadt et al. ..... 15/22.1
3,474,795 A * 10/1969 Lutz et al. ..... 132/119.1
4,525,889 A * 7/1985 Dunau ..... 15/146
5,197,496 A * 3/1993 Nakamura ..... 132/200
5,366,314 A * 11/1994 Young ..... 403/299
5,781,955 A * 7/1998 Hendricks ..... 15/22.1
5,954,064 A * 9/1999 Motherhead ..... 132/262
6,039,052 A * 3/2000 Choi ..... 132/313
6,170,108 B1 1/2001 Knight
6,230,717 B1 * 5/2001 Marx et al. ..... 132/308
6,321,408 B1 * 11/2001 Esterson et al. ..... 15/176.2
6,510,578 B1 1/2003 Cyr et al.
6,546,585 B1 4/2003 Blaustein et al.
6,553,601 B1 4/2003 Major
6,557,212 B2 * 5/2003 Huang ..... 16/430
6,594,850 B2 7/2003 Libman et al.
6,669,397 B1 12/2003 Christion
6,671,919 B2 * 1/2004 Davis ..... 15/167.1
6,709,185 B2 3/2004 Lefevre
6,775,875 B2 8/2004 Ornelas et al.
6,804,852 B1 10/2004 Hay
6,872,026 B2 3/2005 Petner
6,910,241 B2 6/2005 Wang
6,968,590 B2 11/2005 Ponzini
7,059,006 B1 6/2006 Huff et al.
RE39,185 E 7/2006 Noe et al.
7,165,285 B1 1/2007 Hajianpour
7,174,898 B2 * 2/2007 Bosman ..... 132/218
7,185,386 B2 3/2007 Segrea
7,228,864 B2 * 6/2007 Tahara ..... 132/313
7,296,945 B1 * 11/2007 Byun ..... 401/286
7,377,001 B2 5/2008 McKay
7,386,910 B2 6/2008 Minkler et al.
7,386,913 B2 6/2008 Jackson
7,481,592 B2 1/2009 Gueret
7,555,802 B2 7/2009 Bohannon et al.
7,574,768 B2 8/2009 Morris et al.
7,581,275 B2 9/2009 Rekart
7,652,866 B2 1/2010 Barnard et al.
7,690,067 B2 4/2010 Schaefer et al.
7,695,207 B1 4/2010 Laghi
7,698,771 B2 * 4/2010 Gall ..... 15/22.1
7,730,570 B1 6/2010 Billups
7,730,571 B2 * 6/2010 Libman ..... 15/145
7,743,451 B2 6/2010 Kim
7,752,701 B2 7/2010 Bohannon et al.
7,753,609 B2 7/2010 Bouix
7,758,525 B2 7/2010 Thiebaut et al.
7,774,889 B2 * 8/2010 Weaver ..... 15/145
7,784,144 B2 8/2010 Renault
7,789,092 B2 9/2010 Akridge
7,832,954 B2 11/2010 Gueret
7,909,044 B2 3/2011 Tranchant et al.
7,984,528 B2 7/2011 Giacolo et al.
8,016,733 B2 9/2011 Kim
8,042,216 B2 10/2011 Jochim et al.
8,065,774 B2 11/2011 Schiesz et al.
8,234,744 B2 8/2012 Seng et al.
8,250,715 B2 8/2012 Bagley
8,261,398 B2 9/2012 Haigh et al.
8,321,987 B2 12/2012 Bagley
8,332,983 B1 12/2012 Prohoroff
8,353,076 B1 1/2013 Asta
8,448,287 B2 5/2013 Ponzini et al.
8,495,786 B2 7/2013 Naftal
8,566,999 B1 * 10/2013 Casey ..... 15/146
8,777,507 B1 * 7/2014 Carey ..... 401/284
2002/0117423 A1 8/2002 Jackson
2003/0019061 A1 1/2003 Libman et al.
2003/0075195 A1 * 4/2003 Saksa ..... 132/200
2003/0192564 A1 10/2003 Johnson
2003/0217426 A1 * 11/2003 Petner ..... 15/229.2
2004/0003479 A1 1/2004 Ornelas et al.
2004/0010877 A1 1/2004 Jackson
2004/0016073 A1 1/2004 Knutson
2005/0086756 A1 * 4/2005 Petner ..... 15/145
2005/0204497 A1 * 9/2005 Hillenbrand ..... 15/172
2005/0273951 A1 * 12/2005 Karl ..... 15/22.1
2006/0228157 A1 10/2006 Dieudonat
2007/0186946 A1 8/2007 Castleberry
2007/0294849 A1 * 12/2007 Bagley ..... 15/171
2008/0087297 A1 * 4/2008 Rahbar-Dehghan . A46B 5/0095 134/1
2008/0138138 A1 * 6/2008 Gueret ..... 401/24
2008/0142032 A1 * 6/2008 Liberty et al. ..... 132/200
2008/0236607 A1 * 10/2008 Lee ..... A45D 40/264 132/218
2008/0283083 A1 * 11/2008 Piao ..... 132/317
2009/0025746 A1 1/2009 Kim
2009/0049630 A1 * 2/2009 Haigh et al. ..... 15/145
2009/0124985 A1 * 5/2009 Hasenoehrl et al. ..... 604/289
2009/0272395 A1 11/2009 Carey
2009/0280150 A1 11/2009 Kamen et al.
2010/0017990 A1 1/2010 Piao
2010/0043815 A1 * 2/2010 Levy et al. ..... 132/200
2010/0054849 A1 3/2010 Petit
2010/0095973 A1 * 4/2010 Shrier et al. ..... 132/200
2010/0172688 A1 7/2010 Huang
2010/0236571 A1 9/2010 Haziza
2010/0239352 A1 9/2010 Huang
2010/0300470 A1 * 12/2010 Richardson ..... 132/120
2010/0300474 A1 12/2010 Tsai
2010/0300479 A1 * 12/2010 Reishus et al. ..... 132/320
2010/0310298 A1 12/2010 Tsai
2011/0076085 A1 3/2011 Jollet et al.
2011/0223315 A1 * 9/2011 Lim et al. ..... 427/8
2011/0232016 A1 9/2011 Yu et al.
2011/0258798 A1 10/2011 Naftal
2011/0270274 A1 * 11/2011 Hull, Jr. ..... 606/131
2011/0284019 A1 11/2011 Fairweather
2011/0314624 A1 * 12/2011 Kubo ..... 15/167.1
2012/0024308 A1 2/2012 Giron et al.
2012/0066853 A1 * 3/2012 Schiesz et al. ..... 15/145
2012/0111350 A1 5/2012 Finfrock
2012/0124758 A1 * 5/2012 Sabisch et al. ..... 15/21.1
2012/0152272 A1 6/2012 Solovey
2012/0165710 A1 6/2012 Nichols
2012/0260931 A1 * 10/2012 Martin et al. ..... 132/200
2012/0304410 A1 12/2012 Chang
2013/0014338 A1 1/2013 Park
2013/0056016 A1 3/2013 Guay et al.
2013/0098382 A1 * 4/2013 Martin et al. ..... 132/200
2013/0125921 A1 * 5/2013 Celia ..... 132/313
2013/0174365 A1 7/2013 Amicon

OTHER PUBLICATIONS

International Preliminary Report and Written Opinion, dated Oct. 24, 2013, from corresponding International Application Serial No. PCT/US2012/033703.

European Search report, dated Aug. 18, 2015, from corresponding European Application No. EP12771979.7.

* cited by examiner

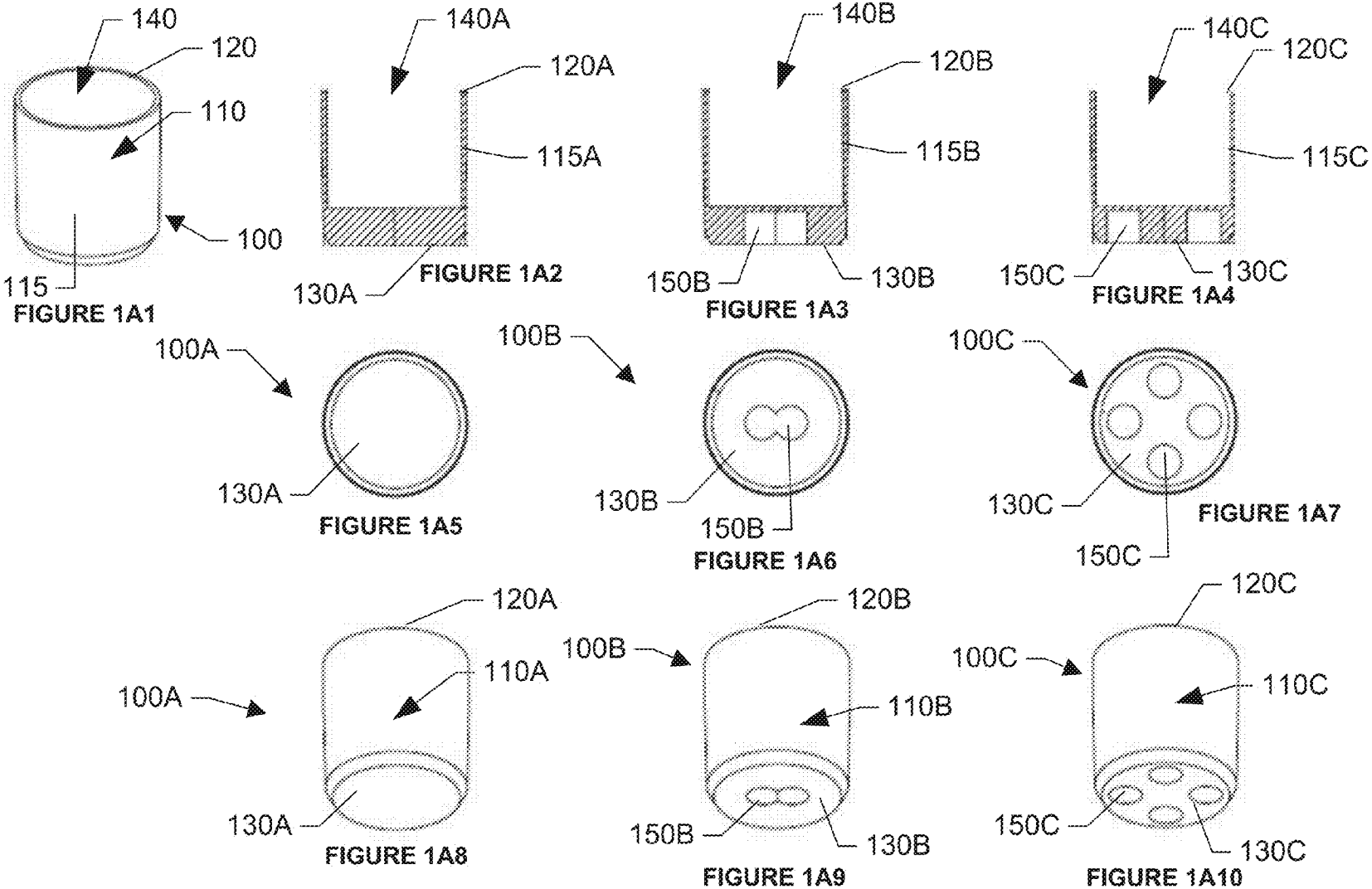
140
120
110
100
115
FIGURE 1A1
140A
120A
115A
130A
FIGURE 1A2
140B
120B
115B
130B
150B
FIGURE 1A3
140C
120C
115C
130C
150C
FIGURE 1A4
100A
130A
FIGURE 1A5
100B
130B
150B
FIGURE 1A6
100C
130C
150C
FIGURE 1A7
120A
110A
130A
FIGURE 1A8
120B
110B
130B
150B
FIGURE 1A9
120C
110C
130C
150C
FIGURE 1A10

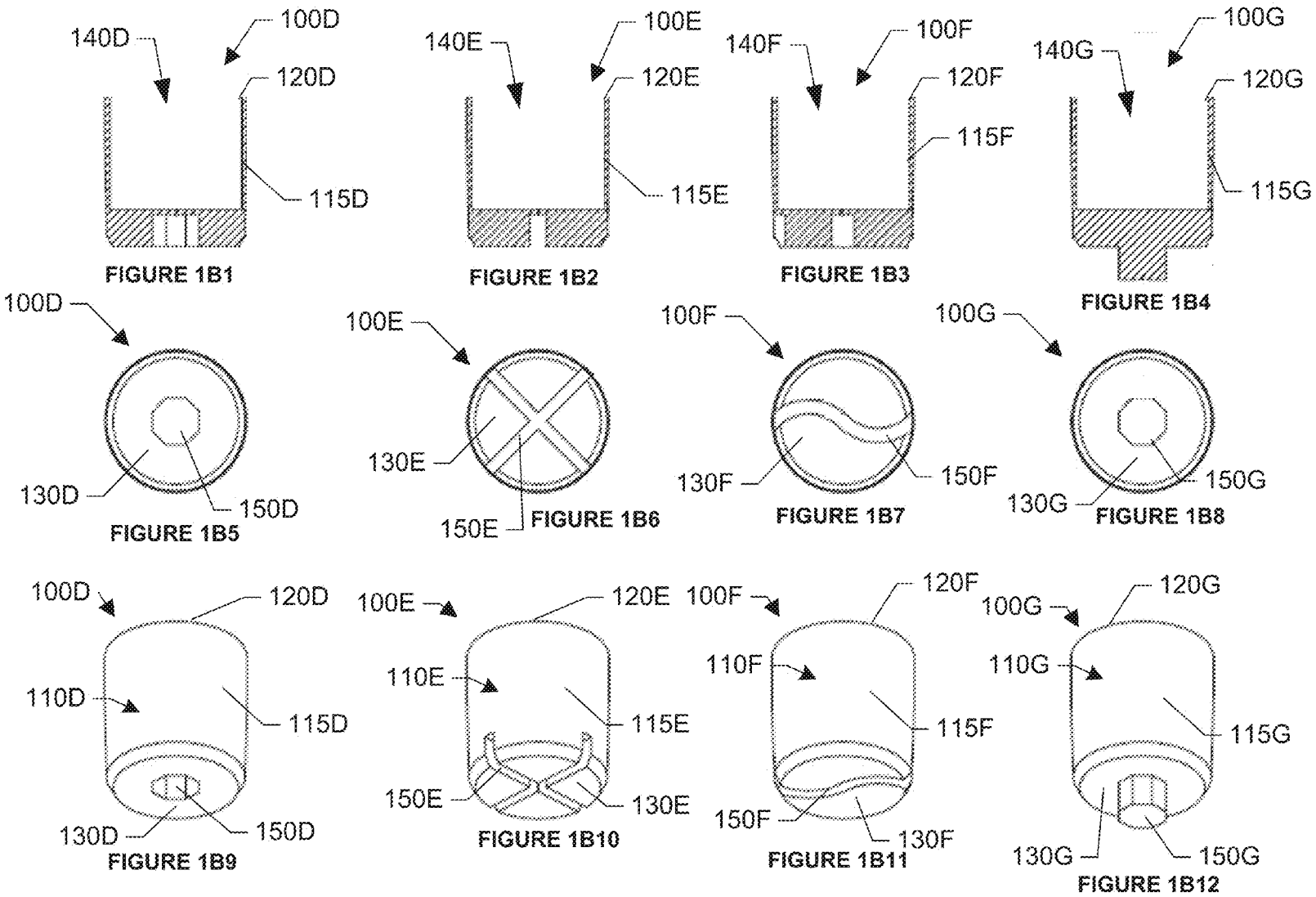
100D
120D
115D
140D
FIGURE 1B1
100E
120E
115E
140E
FIGURE 1B2
100F
120F
115F
140F
FIGURE 1B3
100G
120G
115G
140G
FIGURE 1B4
100D
150D
130D
FIGURE 1B5
100E
130E
150E
FIGURE 1B6
100F
150F
130F
FIGURE 1B7
100G
150G
130G
FIGURE 1B8
100D
120D
115D
150D
110D
130D
FIGURE 1B9
100E
120E
115E
130E
110E
150E
FIGURE 1B10
100F
120F
115F
130F
110F
150F
FIGURE 1B11
100G
120G
115G
150G
110G
130G
FIGURE 1B12

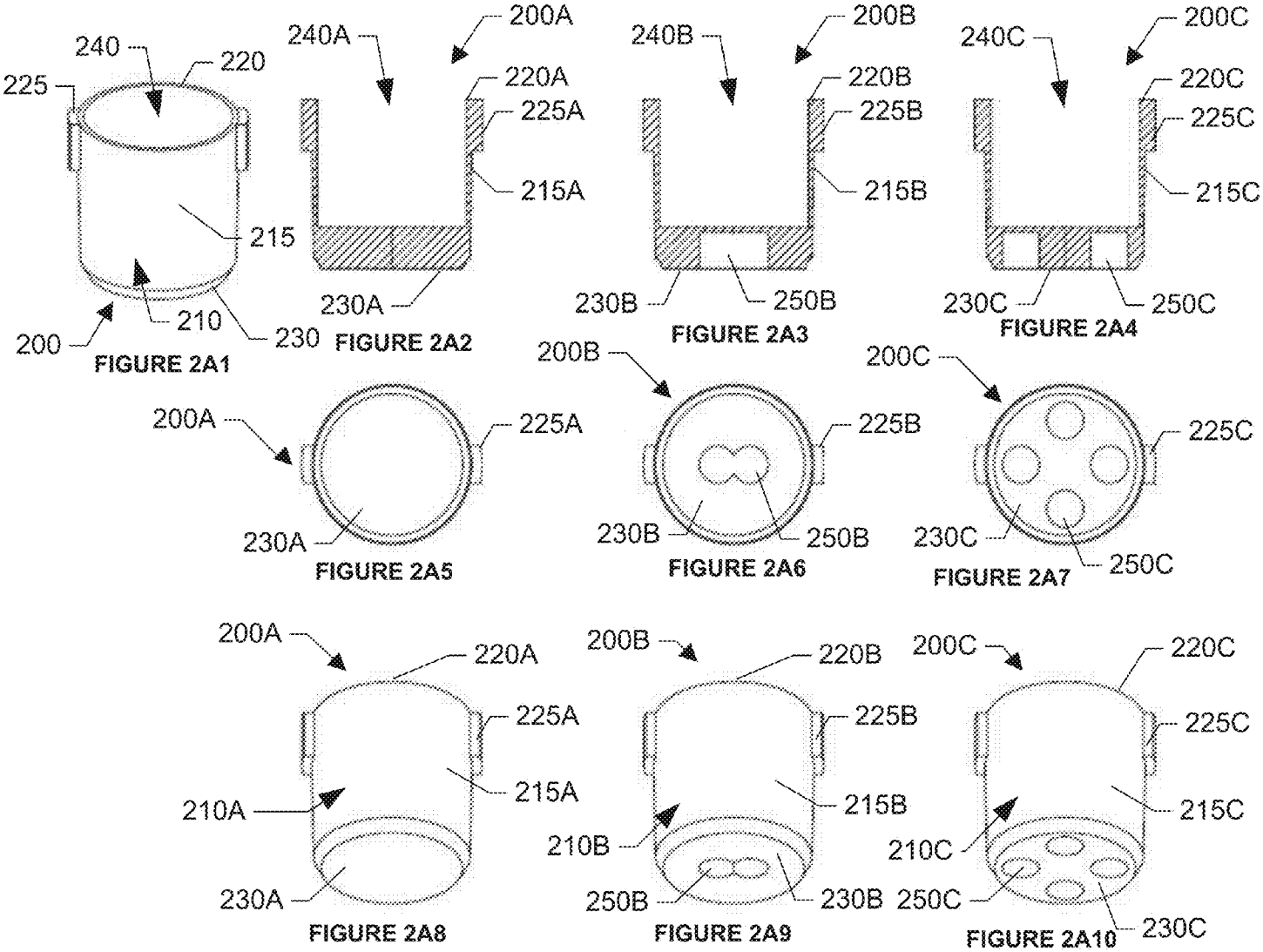
200
225
240
220
210
215
230
FIGURE 2A1
200A
240A
220A
225A
215A
230A
FIGURE 2A2
200B
240B
220B
225B
215B
250B
230B
FIGURE 2A3
200C
240C
220C
225C
215C
250C
230C
FIGURE 2A4
200A
225A
230A
FIGURE 2A5
200B
225B
250B
230B
FIGURE 2A6
200C
225C
250C
230C
FIGURE 2A7
200A
220A
225A
215A
210A
230A
FIGURE 2A8
200B
220B
225B
215B
230B
210B
250B
FIGURE 2A9
200C
220C
225C
215C
230C
210C
250C
FIGURE 2A10

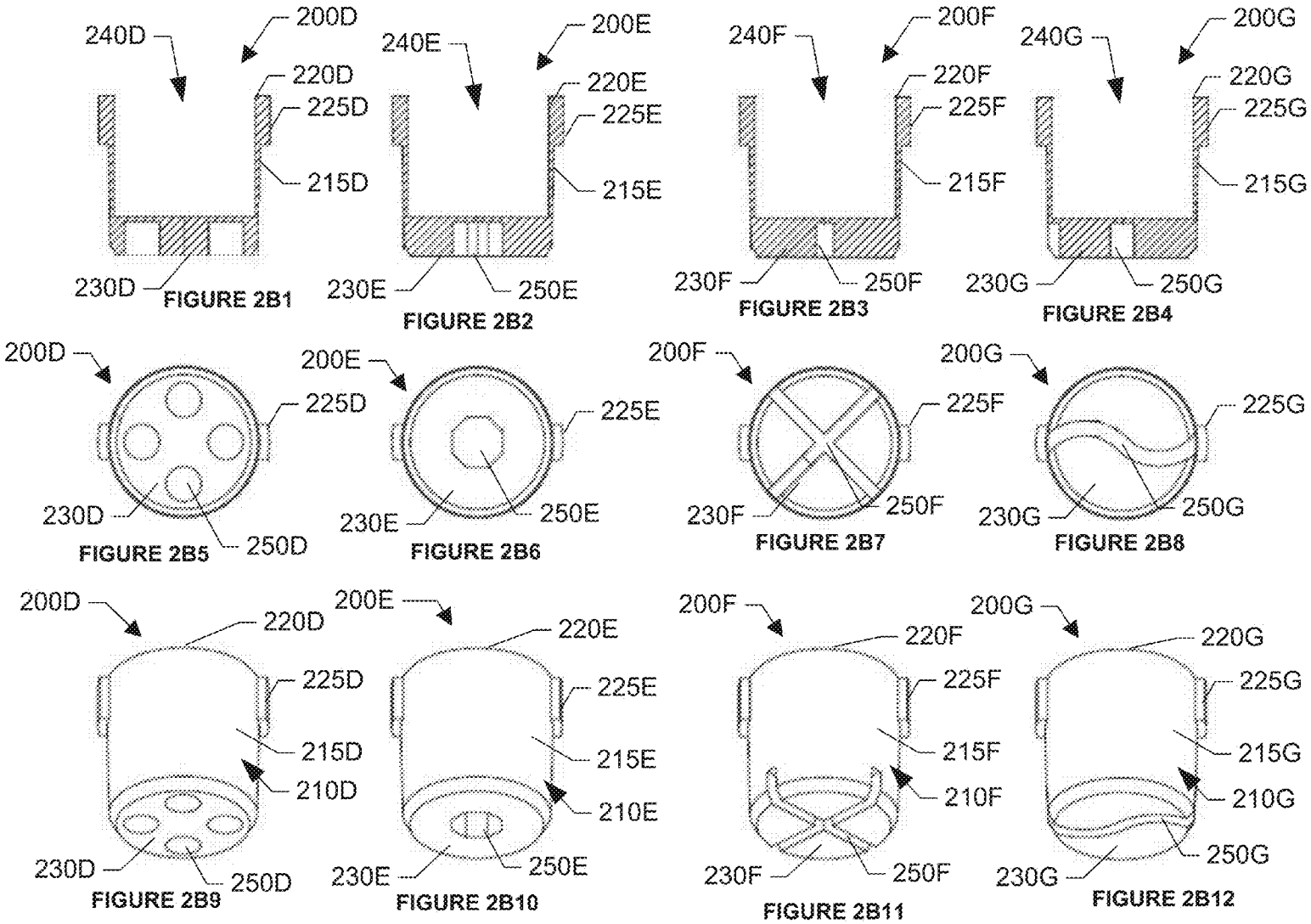
200D
220D
225D
215D
240D
230D
FIGURE 2B1
200E
220E
225E
215E
240E
250E
230E
FIGURE 2B2
200F
220F
225F
215F
240F
250F
230F
FIGURE 2B3
200G
220G
225G
215G
240G
250G
230G
FIGURE 2B4
200D
225D
250D
230D
FIGURE 2B5
200E
225E
250E
230E
FIGURE 2B6
200F
225F
250F
230F
FIGURE 2B7
200G
225G
250G
230G
FIGURE 2B8
200D
220D
225D
215D
210D
250D
230D
FIGURE 2B9
200E
220E
225E
215E
210E
250E
230E
FIGURE 2B10
200F
220F
225F
215F
210F
250F
230F
FIGURE 2B11
200G
220G
225G
215G
210G
250G
230G
FIGURE 2B12

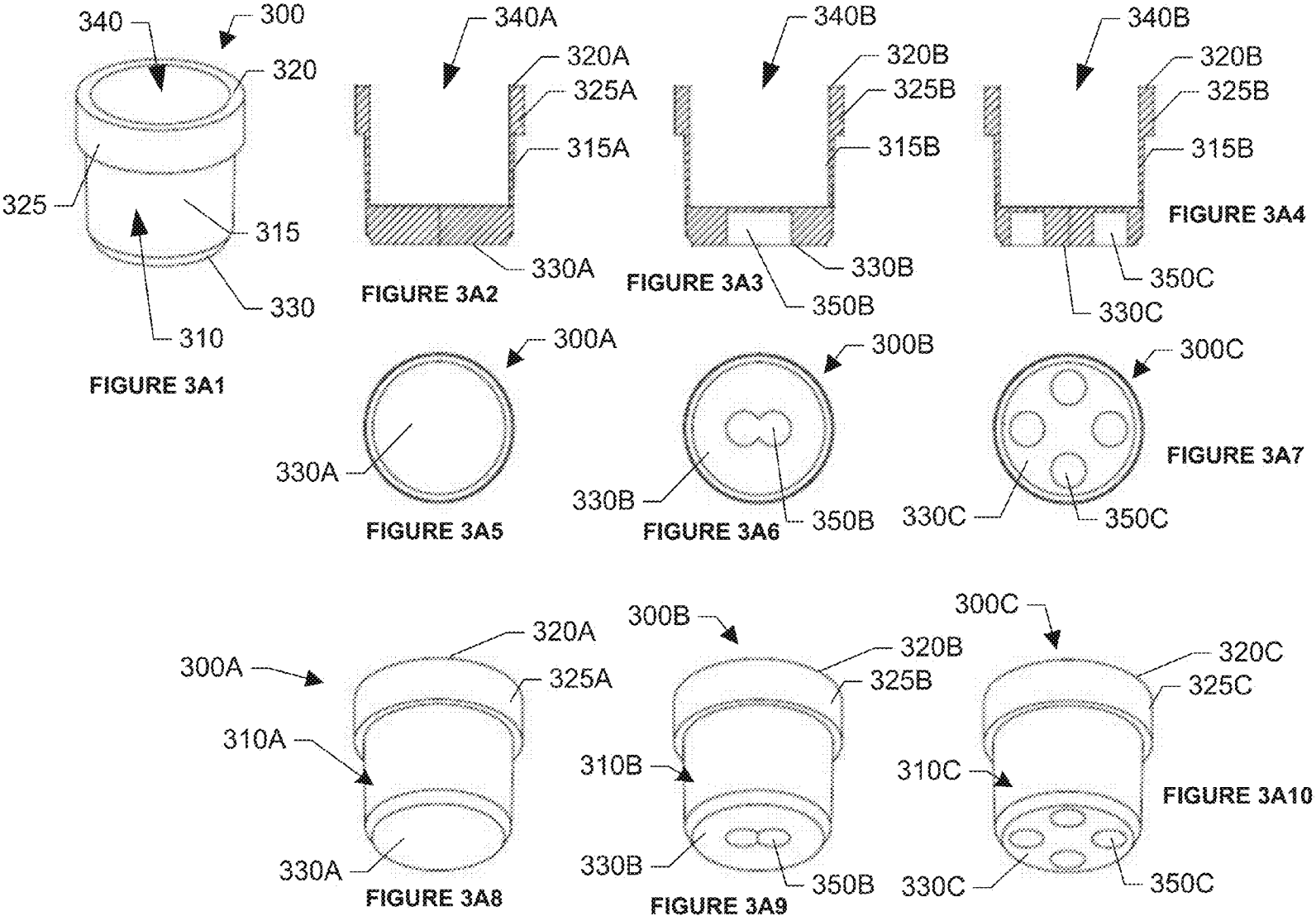
300
320
315
330
340
310
325
FIGURE 3A1
340A
320A
325A
315A
330A
FIGURE 3A2
340B
320B
325B
315B
330B
350B
FIGURE 3A3
340B
320B
325B
315B
350C
330C
FIGURE 3A4
300A
330A
FIGURE 3A5
300B
350B
330B
FIGURE 3A6
300C
350C
330C
FIGURE 3A7
300A
320A
325A
310A
330A
FIGURE 3A8
300B
320B
325B
310B
330B
350B
FIGURE 3A9
300C
320C
325C
310C
330C
350C
FIGURE 3A10

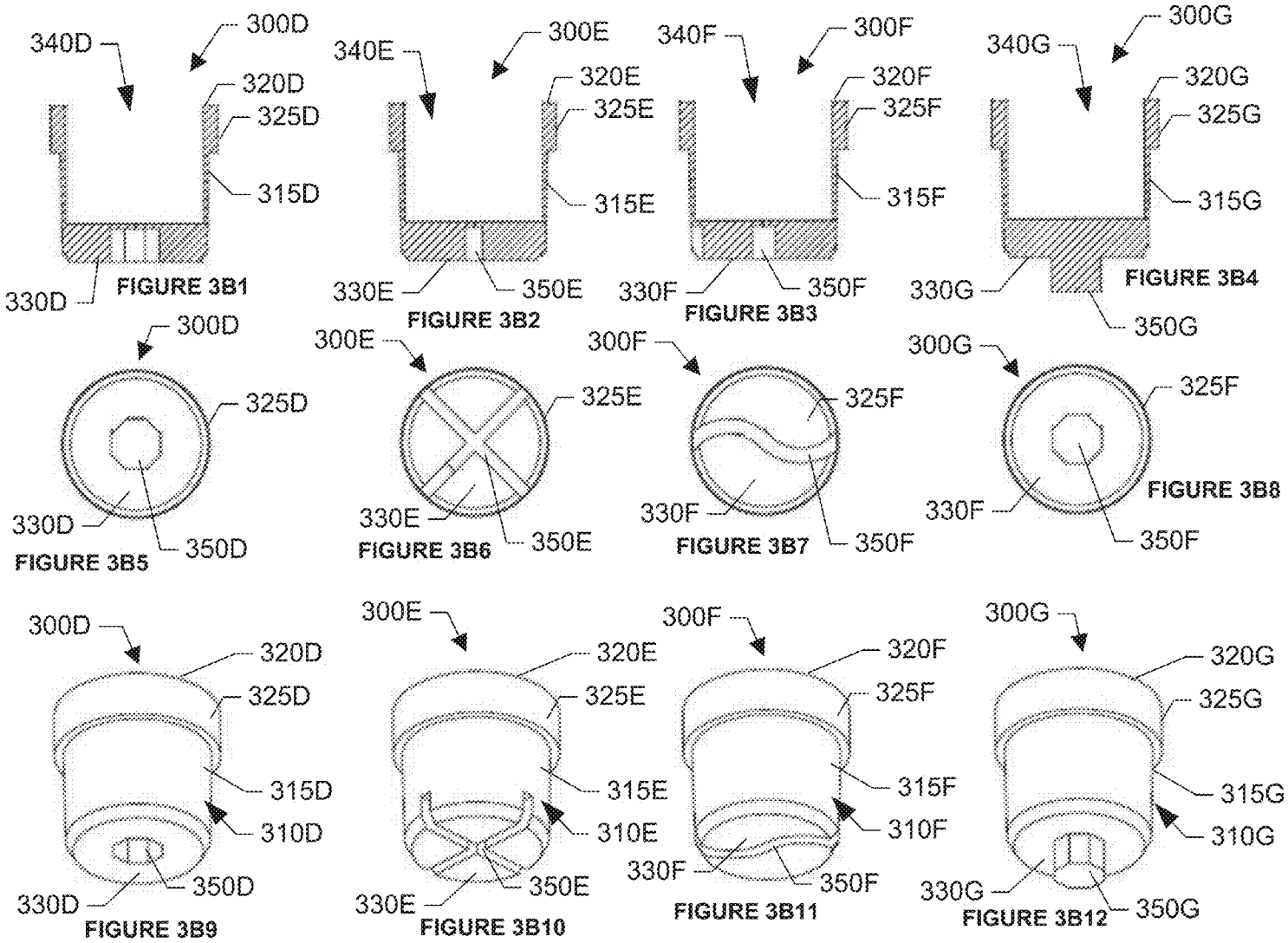
300D
320D
325D
315D
340D
330D
FIGURE 3B1
300E
320E
325E
315E
340E
350E
330E
FIGURE 3B2
300F
320F
325F
315F
340F
350F
330F
FIGURE 3B3
300G
320G
325G
315G
340G
350G
330G
FIGURE 3B4
300D
325D
350D
330D
FIGURE 3B5
300E
325E
350E
330E
FIGURE 3B6
300F
325F
350F
330F
FIGURE 3B7
300G
325F
350F
330F
FIGURE 3B8
300D
320D
325D
315D
310D
350D
330D
FIGURE 3B9
300E
320E
325E
315E
310E
350E
330E
FIGURE 3B10
300F
320F
325F
315F
310F
350F
330F
FIGURE 3B11
300G
320G
325G
315G
310G
350G
330G
FIGURE 3B12

325

340
320
325
322

450

325

325

400
325

APPLICATOR ASSEMBLY

CROSS REFERENCE TO RELATED APPLICATIONS

This application claims the benefit of U.S. Provisional Patent Application No. 61/677,861, filed Jul. 31, 2012, entitled "Applicator Assembly," which is incorporated herein by reference in its entirety.

BACKGROUND

People may desire improved cosmetic and other applicators. Accordingly there is a need for improved systems and methods to address these issues.

SUMMARY

An applicator assembly, according to various embodiments, comprises a substantially cylindrical applicator cup that defines an applicator-receiving recess adjacent a top face of the cup, an attachment recess adjacent a bottom face of the cup, and at least one finger grip disposed adjacent an upper portion of the cup. In particular embodiments, the applicator assembly further comprises an applicator disposed at least partially within the applicator-receiving recess. I particular embodiments, the at least one finger grip is adapted to allow a user to selectively attach and remove the applicator cup from a handle substantially without touching the applicator.

A method of applying cosmetics, according to various embodiments, comprises providing a substantially cylindrical applicator cup defining an applicator-receiving recess adjacent a top face of the cup, an attachment recess adjacent a bottom face of the cup, and at least one finger grip disposed adjacent an upper portion of the cup; and comprising an applicator disposed at least partially within the applicator-receiving recess. In various embodiments, the at least one finger grip is adapted to allow a user to selectively attach and remove the applicator cup from a handle substantially without touching the applicator. In particular embodiments, the method further comprises providing a motorized handle, the motorized handle comprising a rotating portion that substantially corresponds to the attachment recess and is configured to cause the applicator cup to rotate at least partially in response to rotation of the rotating portion when the applicator cup is attached to the motorized handle. In various embodiments, the method further comprises applying cosmetic to the applicator, attaching the applicator cup to the motorized handle, activating the motorized handle, and applying the cosmetic to a desired area of a user's body.

An applicator cup, according to various embodiments, comprises a substantially cylindrical cup body portion comprising a substantially circular top face and a substantially circular bottom face. In particular embodiments, the cup body portion defines a substantially circular applicator receiving recess adjacent the top face and an attachment recess adjacent the bottom face. In various embodiments, the applicator cup further comprises at least one finger grip extending substantially outward from an outer surface of the cup body. In particular embodiments, the applicator cup is configured to enable a user to at least partially insert an applicator into the applicator receiving recess, and to at least partially insert the applicator cup into a handle.

BRIEF DESCRIPTION OF THE DRAWINGS

Various embodiments of an applicator assembly are described below. In the course of this description, reference will be made to the accompanying drawings, which are not necessarily drawn to scale, and wherein:

FIGS. 1A1-1B12 show a first embodiment of an applicator cup for use with a makeup brush, or other suitable applicator, such as one of the makeup brushes that are described in U.S. patent application Ser. No. 13/087,212, entitled "Cosmetic Applicator Systems," which was filed on Apr. 14, 2011, and which is hereby incorporated by reference in its entirety. These figures show the applicator cup with various alternative attachment recesses and, in one embodiment, an attachment shaft. In these embodiments, the applicator cup includes no finger grip adjacent its upper portion. The various structural features of the applicator cup are described in greater detail below.

FIGS. 2A1-2B12 show a second embodiment of an applicator cup with various alternative attachment recesses and, in one embodiment, an attachment shaft. In these embodiments, the applicator cup includes two small finger grips adjacent its upper portion that, in various embodiments, are dimensioned to allow a user to grasp the applicator cup without touching an applicator that is positioned adjacent the applicator cup.

FIGS. 3A1-3B12 show a second embodiment of an applicator cup with various alternative attachment recesses and, in one embodiment, an attachment shaft. In these embodiments, the applicator cup includes a single finger grip that extends circumferentially around (e.g., partially or entirely circumferentially around) its upper portion. In various embodiments, this finger grip is dimensioned to allow a user to grasp the applicator cup without touching an applicator that is positioned adjacent the applicator cup.

DETAILED DESCRIPTION

Figures 4A, 4B, 4C, 4D, 4E, 4F, 4G:
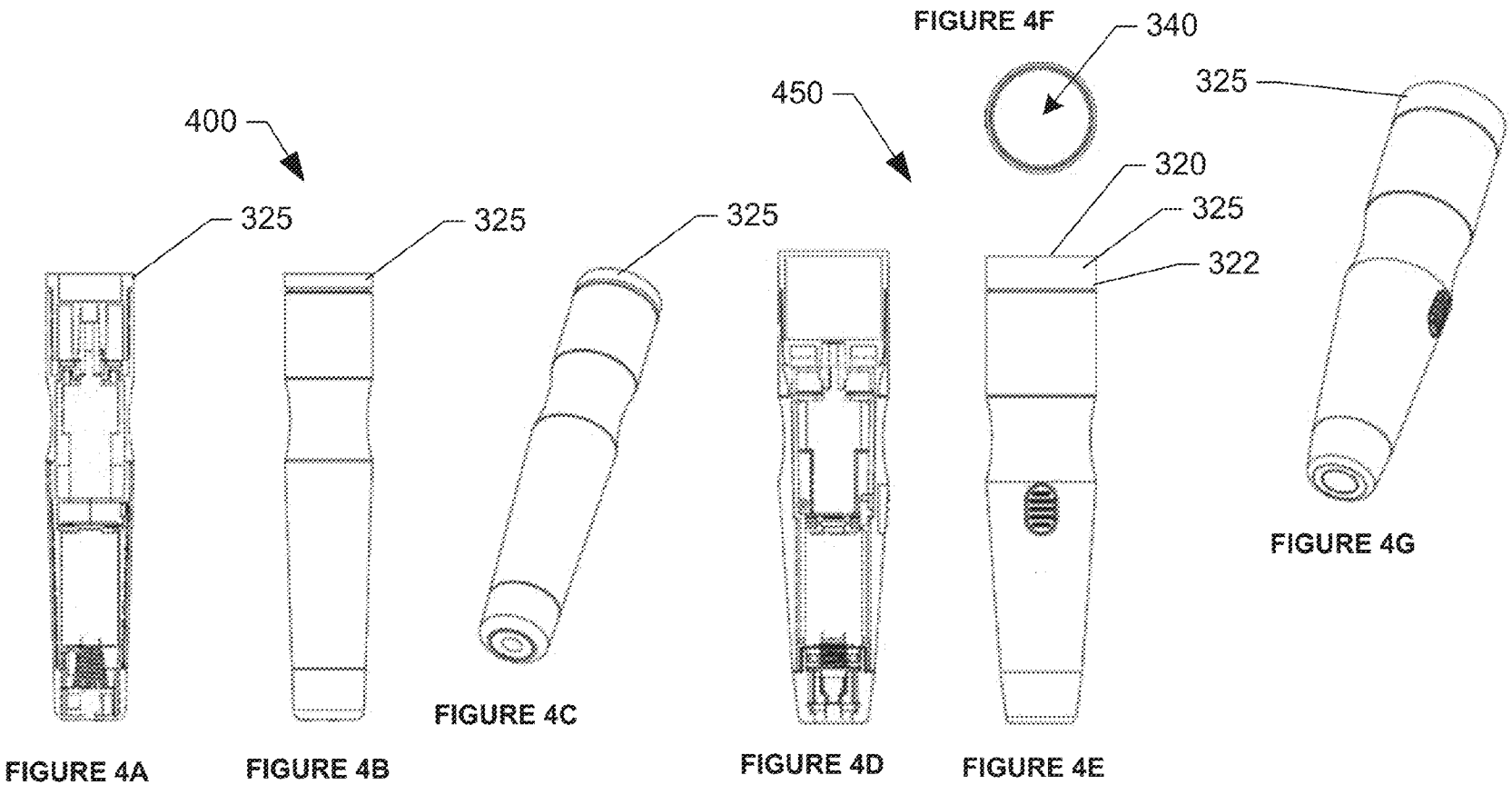
FIGS. 4A-4G shows exemplary handles for use with an applicator cup, such as the applicator cups shown in FIGS. 1A1-1B12, FIGS. 2A1-2B12, and FIGS. 3A1-3B12.
Figure 5A:
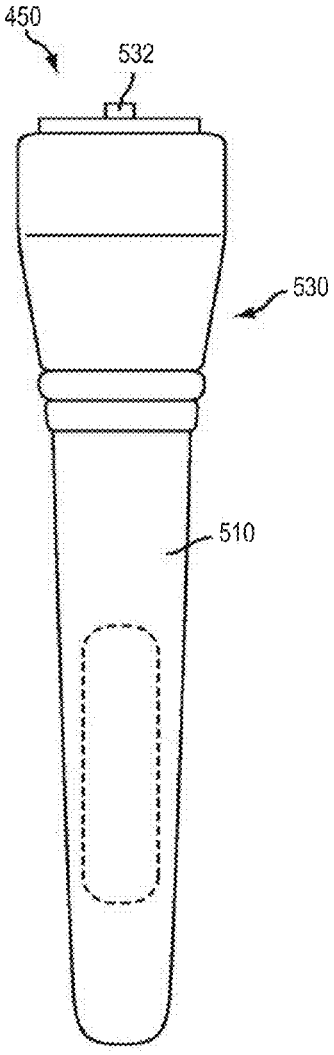
FIGS. 5A-5H is an illustration of a motorized brush su ort and a plurality of cosmetic brushes, according to a particular embodiment.
Figure 5B:
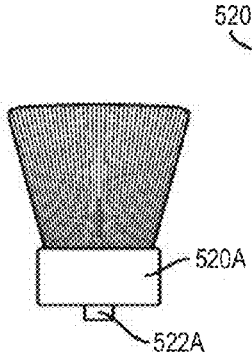
Figure 5C:
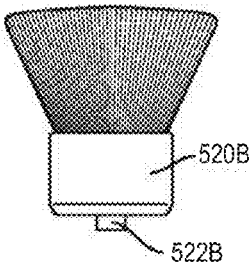
Figure 5D:
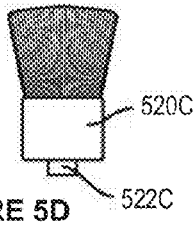
Figure 5E:
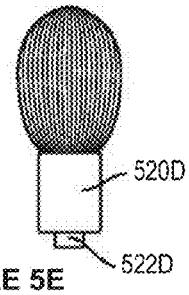
Figure 5F:
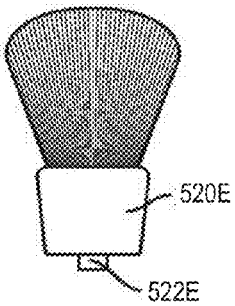
Figure 5G:
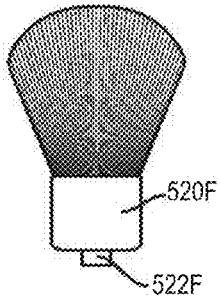
Figure 5H:
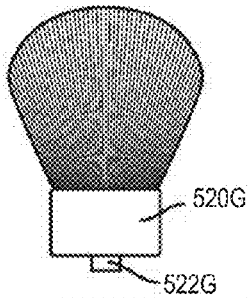

Various embodiments will now be described more fully hereinafter with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Applicator Cup

An applicator cup 100, 200 and 300 according to various embodiments are shown in FIGS. 1A1-1B12, 2A1-2A12 and 3A1-3A12, respectively. As shown in these figures, the applicator cup 100, 200 and 300 may comprise a substantially cylindrical (e.g., cylindrical), at least partially hollow, cup body portion 110, 210 and 310 that includes a side wall 115, 215 and 315, a top face 120, 220 and 320, and a bottom face 130, 230 and 330, respectively. In particular embodiments, the cup body portion 110, 210 and 310 may have a substantially circular (e.g., circular) cross section. The cup body portion 110, 210 and 310 may define, in various embodiments, an applicator-receiving recess 140, 240 and 340 adjacent (e.g., extending through) the cup's top face 120, 220 and 320, and an attachment recess adjacent (e.g., extending through) the cup's bottom face 130, 230 and 330, respectively. In some embodiments, such as the embodiments shown in FIGS. 2A1-2B12, the applicator cup 200 includes at least one finger grip 225A-225G disposed adjacent the cup's top face 220A-220G. The finger grip 225A-225G may be, for example, a protrusion that extends outwardly from the cup body portion's outer surface.

Cup

As shown in FIG. 1A1, the cup's body portion 110 may be substantially cylindrical (e.g., cylindrical) with a diameter between, for example, about 20 mm and about 40 mm. In particular embodiments, the cup's body portion 110 may have a diameter of about 29.4 mm. In various embodiments, the cup's body portion 110 may have a height between about 20 mm and about 40 mm. In particular embodiments, the cup's body portion 110 has a height of 31.8 mm. In the embodiment shown in FIG. 1A, the cup's body portion 110 defines a top 120 and bottom face 130 and defines a beveled edge on the outer circumference of the edge of the cup's bottom face 130. In other embodiments, the cup's body portion 110 may define any other suitable edge (e.g., round or square) on the outer circumference of the edge of the cup's bottom face 130.

Applicator-Receiving Recess

In the embodiments shown in FIGS. 1A1, 2A1 and 3A1, the cup's body portion 110, 210 and 310 defines an applicator-receiving recess 140, 240 and 340, respectively that is substantially centered (e.g., centered) relative to the cup's top face 120, 220 and 320. In the embodiments shown in these figures, the applicator-receiving recess 140, 240 and 340 is substantially cylindrical (e.g., cylindrical) and has a diameter that is between about 15 mm and 39 mm. In particular embodiments, the applicator-receiving recess 140, 240 and 340 has a diameter of about 28.1 mm. In certain embodiments, the applicator-receiving recess 140, 240 and 340 has a diameter that is about 0.5 mm less than the cup's diameter. In the embodiments shown in these figures, the applicator-receiving recess 140, 240 and 340 is between about 18 mm and 39 mm deep. In particular embodiments, the applicator-receiving recess 140, 240 and 340 is about 24 mm deep. In other embodiments, the applicator-receiving recess 140, 240 and 340 may be any depth suitable for housing an applicator.

In various embodiments, the cup's body portion 110, 210 and 310 may be adapted to maintain an applicator at least substantially within (e.g., within) the respective applicator-receiving recess 140, 240 and 340. The applicator may, for example, comprise a brush, sponge, or any other suitable applicator for applying either a liquid or powder substance (e.g., such as cosmetics, makeup, lotion, sunblock, sunscreen, moisturizer, foundation, concealer, eye shadow, blush, bronzer, cream, or any other appropriate substance). In various embodiments, an applicator may be adapted for applying substances in a plurality of forms (e.g., liquid, powder, or any other suitable form). In particular embodiments, the applicator is adapted to apply cosmetics or lotions while rotating. The applicator may, for example, be adapted to substantially maintain its shape and structure after repeated use.

The applicator may include a brush comprising bristles of any suitable length (e.g., between about 10 mm and about 80 mm). The bristles may be made of any suitable material (e.g., natural or synthetic material).

Attachment Recess

As shown in FIGS. 1A1-1B12, the cup's body portion 110B-110F may define one or more attachment recesses (e.g., attachment recesses 150B-150F, respectively) that are suitable for use in attaching the applicator cup 110B-110F to a handle when the cup's body portion 110B-110F is attached to the handle. The handle may, for example, be a motorized handle or any other handle suitable for use in applying cosmetics. Referring briefly to FIGS. 4A-4C, an exemplary handle 400 and an exemplary motorized handle 450 are shown.

As may be understood from FIGS. 1A1-1B12, the attachment recess 150B-150F may be defined adjacent the cup's respective bottom face 130B-130F. The attachment recess 150B-150F may be sized to receive a corresponding portion (e.g., a rotating portion) of a motorized handle when the applicator cup 100A-100F is attached to the motorized handle. In various embodiments, the engagement between this portion of the motorized handle and the applicator cup 100A-100F causes the applicator cup 100A-100F to rotate when the motorized handle's rotating portion rotates. In particular embodiments, the applicator cup 100A-100F may define an attachment recess that is between about 2 mm deep and about 14 mm deep.

FIGS. 1A1-1B11 show various embodiments of the applicator cup 100A-100G having different attachment recess configurations 150B-F. These exemplary embodiments are described more fully below:

No Attachment Recess

In particular embodiments, the applicator cup 110 may define no attachment recess (See applicator cup 110A in FIGS. 1A1, 1A2, 1A5 and 1A8). In such embodiments, the applicator cup 110 may be adapted to be attached to a brush without the use of an attachment recess.

Figure Eight

The brush cup 100B shown in FIGS. 1A3, 1A6 and 1A9 defines an attachment recess 150B that is substantially centered (e.g., centered) adjacent the cup's bottom face 130B, and that has a profile that includes two at least partially overlapping circles.

Multi-Hole

The brush cup 100C shown in FIGS. 1A4, 1A7 and 1A10 defines four attachment recesses 150C whose profiles are substantially circular (e.g., circular). The attachment recesses 150C are defined in an outer portion of the cup's bottom face 130C. In the embodiment shown in this figure, the cup 110C defines the four attachment recesses 150C that are substantially evenly-spaced (e.g., evenly-spaced) about a circle having a radius that is substantially centered (e.g., centered) on the cup's bottom face 130C. In other embodiments, the cup 110C may define any other suitable plurality of attachment recesses (e.g., two, three, etc.).

Multi-Sided

The brush cup 100D shown in FIGS. 1B1, 1B5 and 1B9 defines an attachment recess 150D that is substantially centered (e.g., centered) adjacent the cup's bottom face 130D, and that has a profile that is substantially octagonal (e.g., octagonal). In various embodiments, the cup 110D may define an attachment recess that is substantially centered (e.g., centered) adjacent the cup's bottom face 130D. In this embodiment, the profile of the attachment recess is that of a shape with any suitable number of sides (e.g., triangular, square, pentagonal, hexagonal, heptagonal, etc.).

Cross

The brush cup 100E shown in FIGS. 1B2, 1B6 and 1B10 defines two attachment recesses 150E that are substantially rectangular (e.g., rectangular) and substantially perpendicular (e.g., perpendicular) to one another (e.g., so that the recesses 150E cooperate to form a cross). In this embodiment, the two attachment recesses are each substantially parallel (e.g., parallel) to a radius of the cup's bottom face 130E.

Serpentine

In the embodiment 100F shown in FIGS. 1B3, 1B7 and 1B11, the cup 110F defines an attachment recess 150F that is substantially S-shaped (e.g., S-shaped).

Shaft

In particular embodiments, such as the embodiment 100G shown in FIGS. 1B4, 1B8 and 1B12, the cup 110G comprises an attachment shaft 150G (rather than an attachment recess). In the embodiment shown in this figure, the attachment shaft 150G extends substantially perpendicularly (e.g., perpendicularly) from and is substantially centered relative to the cup's bottom face 130G. In the embodiment 100G shown in this figure, the attachment shaft 150G has a profile that is substantially octagonal (e.g., octagonal) and that extends about 7 mm from the cup's bottom surface. In other embodiments, the attachment shaft 150G may extend between about 3 mm and about 15 mm from the cup's bottom surface.

In various embodiments, the attachment shaft 150G may have any other suitable profile. For example, the attachment shaft 150G may have a profile that is similar to any of the profiles of the attachment recesses described above (e.g., figure eight, multi-hole, multi-sided, cross, or serpentine).

Finger Grip

In various embodiments, such as the embodiment shown in FIGS. 2A1-2B12, the applicator cup's body portion 210A-210G may comprise at least one finger 225A-225G grip that extends radially outward from the cup's outer surface. In the embodiment shown in FIGS. 2A-2B, the cup's body portion 210A-210G comprises two finger grips 225A-225G that are disposed on opposing faces adjacent the cup's upper portion 220A-220G. In various embodiments, the finger grips 225A-225G may have a width (between the portion of the finger grip that engages the rest of the cup, and the outer portion that a user would engage when using the finger grip to lift the cup) between about 5 mm and 15 mm. In particular embodiments, the finger grips 225A-225G may have a width of about 7 mm. In various embodiments, the finger grips 225A-225G have a height of between about 4 mm and about 15 mm. In particular embodiments, the finger grips 225A-225G have a height of about 9.6 mm.

It should be understood that finger grips 225A-225G may, for example, have any width and height suitable for allowing a user to grip the applicator cup's body portion 210A-210G using the finger grips 225A-225G (e.g., by squeezing their thumb and index finger against the respective finger grips in order to lift or move the cup). In particular embodiments, the finger grips 225A-225G may be of a suitable size and shape to maintain the user's fingers spaced apart from the applicator when handling the applicator cup.

In certain embodiments, such as the embodiment shown in FIGS. 3A1-3B12, the applicator cup body portions 310A-310G may comprise a finger grip 325A-325G that extends along substantially the entire circumference of the cup's outer surface. In the embodiment shown in these figures, the finger grip 325A-325G is disposed adjacent the cup's upper portion 320A-320G.

In various embodiments, the finger grips may be adapted to allow a user to insert the applicator cup 200A-200G or 300A-300G into, or remove it from, a motorized handle substantially without touching the applicator so that a lower portion 322 of the finger grip is adjacent the motorized handle (FIGS. 4A-4G). In particular embodiments, the applicator cup 210A-210G is configured to enable a user to use the applicator cup 210A-210G in conjunction with the motorized handle to apply cosmetics. In various embodiments, the applicator cup 210A-210G is configured to rotate at a speed of between about 92 and about 489 revolutions per minute when used in conjunction with the motorized handle. In particular embodiments, the motorized handle may be configured to apply a torque of between about 6 and about 34 ounce inches. In various embodiments, the motorized handle may be configured to enable the user to adjust the speed of the motorized handle's motor. In other embodiments, the motorized handle may be configured to enable a user to adjust a torque that the motorized handle applies to the applicator cup 210A-210G when the applicator cup 210A-210G is being used in conjunction with the motorized handle.

In particular embodiments, the finger grips 225A-225G may be adapted to allow the user to move, install, uninstall, and/or otherwise use the applicator cup 200A-200G substantially without touching any of the substance that is to be applied with the applicator (e.g., makeup, lotion, liquid foundation, powder foundation, concealer, eye shadow, blush, bronzer, or any other substance that may be applied with the applicator). In various embodiments, the applicator may be adapted for longer use as a result of avoiding exposure to contaminants (e.g., oils) on the user's hands.

Exemplary Use

The applicator cup described above may be utilized as part of a method of applying any of a plurality of cosmetics or other substances to a user's skin. The user may first select an applicator assembly that includes: (1) an applicator cup; and (2) an applicator that is installed in the applicator cup, so that the applicator extends beyond the end of the applicator cup's top face. The applicator may be, for example, a particular brush or sponge that is suitable for applying the particular cosmetic, or other substance to the user's skin. Suitable substances include both powder or liquid substances, for example, lotion, liquid foundation, powder foundation, concealer, eye shadow, blush, bronzer, or any other suitable substance. The user may then pick up the applicator assembly by lifting it via the finger grips on the sides of the applicator cup.

Next, the user may attach the applicator assembly, attachment recess side first, to a suitable handle. The handle may, for example, be a motorized handle or any other handle suitable for applying cosmetics or other substances (e.g., a non-motorized handle). The handle may define a substantially circular (e.g., circular) recess with a diameter that is sufficiently large to allow the applicator assembly to be easily inserted into the recess and to rotate within the recess, and that is sufficiently small to allow the applicator assembly to fit snuggly within the recess once inserted. While inserting the cup into the handle's recess, the user may align the cup's attachment recess(es) with the handle's corresponding attachment protrusion(s). In particular embodiments, when the applicator assembly is installed on the handle, the attachment protrusion(s) may extend from the handle into the handle's recess(es). In various embodiments, such as in the case of a makeup brush assembly that includes a motorized handle, the attachment protrusions may be adapted to rotate about an axis, which may, for example, be substantially centered (e.g., centered) within and run substantially perpendicular to (e.g., perpendicular to) the handle's recess. An example of a suitable handle for use with the applicator assembly is described in U.S. patent application Ser. No. 13/087,212, entitled "Cosmetic Applicator Systems," which was filed on Apr. 14, 2011, and which—as noted above—is hereby incorporated by reference in its entirety.

As illustrated in FIGS. 5A-5H, a motorized brush support (such as the motorized handle 450 discussed above with reference to FIGS. 4A-4G) may be compatible with a set of cosmetic brushes 520 for applying a cosmetic to a surface area such as the face. The motorized brush support 450, as shown, includes a base portion (in this case, a handle 510), a head assembly 530 and a coupling assembly 532. The coupling assembly 532 may extend away from the head assembly 530, as shown, or it may be integrated within the head assembly 530. In some embodiments, each of the cosmetic brushes 520A-520G may include a connector 522A-522G, respectively, for attaching to or otherwise engaging with the coupling assembly 532. The connector 522A-522G may extend below the base of a brush, as shown, or it may be integrated within the base of the brush. The connector 522A-522G may include any type of connector or fastening mechanism that fits or otherwise engages with the coupling assembly 532. Any of a variety of combinations of connectors 522A-522G and coupling assemblies 532 known to those skilled in the art may be used.

Any of a variety of cosmetic brushes (such as one or more specialty makeup brushes) may be collected in a set 520 for use with any particular application. In an exemplary embodiment, the set of cosmetic brushes 520, as illustrated, may include one or more of the following brush types: a Liquidator Brush 520A, a Powder Foundation Brush 520B, an Under-Eye Concealer Brush 520C, an Upper Eyelid Shadow Brush 520D, a Blush Blaster Brush 520E, a Disco Shine Brush 520F, and a Bronzer Brush 520G.

The Liquidator Brush 520A may be used to apply and distribute a liquid or cream foundation. The Powder Foundation Brush 520B may be used to apply and distribute a powder foundation or base. The Under-Eye Concealer Brush 520C may be used to apply and distribute a concealer compound under the eyes and other areas, as desired. The Upper Eyelid Shadow Brush 520D may be used to apply and distribute a shadow compound to the upper eyelids. The Blush Blaster Brush 520E may be used to apply and distribute a blush compound to the "S zone" or cheeks and other areas, as desired. The Disco Shine Brush 520F may be used to apply and distribute a decorative compound such as a colored powder or glitter to any area. The Bronzer Brush 520G may be used to apply and distribute a bronzing compound to any area. In use, any of the set of brushes 520 may be used to apply, distribute, and blend any of these compounds to any area of the face.

The cosmetic brushes in a set 520 may include any number of different brush types. A brush may include a base, a collection of bristles, and a ferrule or other component for holding the bristles to the base. The bristles may be made of natural animal hair, synthetic fibers, or a blend. The base of the brush, in some embodiments, may be made of different materials, in various colors. The brush may include one or more words or indicia correlated to a particular manufacturer, product name, trademark, business, or social cause. The set of brushes 520 may be color coded or otherwise grouped by a visible feature that indicates to the user each brush's intended use and/or its association with a particular set of brushes. Each cosmetic brush may be characterized by its particular features; for example, its overall size and shape, the shape of its base, the ferrule type, the bristle composition (natural, synthetic or blend, for example), the bristle length, the bristle color, the shape of each bristle end (rounded or blunt, smooth or rough, for example), the overall shape made by all the bristles together (fan-shaped, cone-shaped, flat, rounded, pointed, and the like), the bristle spacing and density (measured, for example, in bristles per square inch) and the bristle stiffness (from rigid bristles like a toothbrush, to bristles as limp as cotton thread). For example, in the context of face makeup, a first cosmetic brush (such as The Liquidator Brush 520A illustrated in FIG. 5B) may be relatively large in size, flat across the end of the bristles, and relatively rigid in stiffness. A second cosmetic brush (such as The Upper Eyelid Shadow Brush 520D illustrated in FIG. 5E) may be relatively small in size, rounded in shape across the end, and softer in stiffness.

The user may then apply makeup using the handle and applicator cup assembly by, for example, placing cosmetic on the applicator, activating the motorized handle, and applying cosmetic to the desired area of the body using the rotating applicator). When the user wishes to apply makeup using a different applicator, the user may simply detach the current applicator assembly from the handle, attach a new applicator assembly to the handle, and proceed as described above.

Other Suitable Uses

Stand-Alone Applicator Cup

In particular embodiments, an applicator cup such as the applicator cup described above may be utilized as a stand-alone applicator (e.g., may be suitable for applying a substance without attaching the applicator cup and applicator to a separate handle). In such embodiments, a user may apply a substance (e.g., makeup, cosmetic, lotion, cream, or other suitable substance) by installing an appropriate applicator in the applicator cup, and applying the substance by gripping the applicator cup (e.g., using their fingers).

Applicator Cup Combined with Recess-Free Handle

In particular embodiments, the applicator cup is adapted for use with a suitable handle that does not define a recess for accepting the applicator cup. In such embodiments, the applicator cup may be adapted to attach to an end of the handle such that the applicator cup is at least partially exposed (e.g., fully exposed) when attached to the handle.

Upright Storage

In particular embodiments, the applicator cup is adapted to stand substantially upright (e.g., upright) on its bottom face when placed, for example, on a flat support surface (e.g., a counter, table, or other suitable surface). In such embodiments, an applicator installed in the applicator cup may sit upright within the applicator cup's applicator-receiving recess when the applicator cup is standing on its bottom face. In particular embodiments, placing the applicator cup in a position in which the applicator cup is standing on its bottom face may at least substantially (e.g., substantially) protect the integrity of the installed applicator (e.g., by allowing the applicator to stand in a rested, upright position in which the applicator does not come into contact with the support surface (e.g., as the applicator would if it were rested, for example, on its side)).

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. As a particular example, in certain embodiments, the applicator cup may be sufficiently thick to allow a user to grip the cup substantially without touching the applicator. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

We claim:

1. A motorized makeup applicator comprising:

(A) a motorized applicator support comprising:

a base portion;

a first coupling assembly that is configured for allowing a user to selectively couple any particular one of a plurality of different types of makeup applicators adjacent said base portion; and a motor for selectively rotating a makeup applicator that is mounted, via said first coupling assembly, adjacent said base portion; and (B) a first makeup applicator cup, comprising:

a substantially cylindrical applicator body portion comprising:

a side wall;

a top face; and a bottom face, wherein said applicator body portion defines a substantially cylindrical applicator-receiving recess adjacent said top face;

a second coupling assembly adjacent said bottom face configured for cooperating with said first coupling assembly to maintain said first makeup applicator cup adjacent said base portion of said motorized applicator support; and at least one applicator comprising at least one bristle, wherein the at least one bristle is disposed at least partially within said applicator-receiving recess; wherein:

said applicator body portion is configured to maintain said at least one applicator at least partially within said applicator-receiving recess;

said bottom face separates said applicator receiving recess from said second coupling assembly so that said applicator receiving recess is not in fluid communication with said second coupling assembly; and said motor is configured to rotate said first makeup applicator cup with respect to said base portion about a central axis when said first makeup applicator cup is coupled adjacent said motorized applicator support.

2. The motorized makeup applicator of claim 1, wherein said motor is configured to apply a torque of between about 6 and about 34 ounce inches to said first makeup applicator cup when said first makeup applicator cup is coupled adjacent said motorized applicator support.

3. The motorized makeup applicator of claim 2, wherein said motorized applicator support is configured to enable said user to adjust said torque that said motor applies to said first makeup applicator cup when said first makeup applicator cup is coupled adjacent said motorized applicator support.

4. The motorized makeup applicator of claim 1, wherein:

said base portion of said motorized applicator support defines a substantially circular recess having a diameter that is substantially similar to a diameter of said applicator body portion; and said applicator body portion is disposed at least partially within said recess when said first makeup applicator cup is coupled adjacent said motorized applicator support.

5. A motorized makeup applicator comprising:

(A) a motorized applicator support comprising, a base portion;

a first coupling assembly that is configured for allowing a user to selectively couple any particular one of a plurality of different types of makeup applicators adjacent said base portion; and a motor for selectively rotating a makeup applicator that is mounted, via said first coupling assembly, adjacent said base operation; and (B) a first makeup applicator cup, comprising, a substantially cylindrical applicator body portion comprising:

a side wall;

a top face; and a bottom face, wherein said applicator body portion defines a substantially cylindrical applicator-receiving recess adjacent top face;

a second coupling assembly adjacent said bottom face configured for cooperating with said first coupling assembly to maintain said first makeup applicator cup adjacent said base portion of said motorized applicator support; and at least one applicator disposed at least partially within said applicator-receiving recess, wherein:

said applicator body portion is configured to maintain said at least one applicator at least partially within said applicator-receiving recess;

said bottom face separates said applicator receiving recess from said second coupling assembly so that said applicator receiving recess is not in fluid communication with said second coupling assembly; and said motor is configured to rotate said first makeup applicator cup with respect to said base portion about a central axis when said first makeup applicator cup is coupled adjacent said motorized applicator support wherein said base portion of said motorized applicator support defines a substantially circular recess having a diameter that is substantially similar to a diameter of said applicator body portion; and said applicator body portion is disposed at least partially within said recess when said first makeup applicator cup is coupled adjacent said motorized applicator support said applicator body portion comprises at least one finger grip disposed adjacent said top face of said applicator body portion that extends radially outward from an outer portion of said side wall of said applicator body portion; and said at least one finger grip is configured to enable said user to selectively couple said first makeup applicator cup adjacent said base of said motorized applicator support substantially without said user touching said at least one applicator.

6. The motorized makeup applicator of claim 5, wherein said at least one applicator is a makeup brush.

7. The motorized makeup applicator of claim 6, wherein:

said at least one applicator comprises a makeup brush comprising a plurality of bristles disposed at least partially within said applicator-receiving recess; and said motorized applicator support is configured to enable said user to use said motorized applicator support and said first makeup applicator cup to rotationally apply a first cosmetic to a first portion of said user's body.

8. The motorized makeup applicator of claim 7, wherein:

said at least one finger grip comprises at least two finger grips; and said at least two finger grips are disposed on opposing outer portions of said applicator body portion.

9. The motorized makeup applicator of claim 7, wherein:
said at least one finger grip extends substantially around an entire circumference of said side wall of said applicator body portion.

10. A motorized makeup applicator comprising:
(A) a motorized applicator support comprising:
a base portion;
a first coupling assembly that is configured for allowing a user to selectively couple any particular one of a plurality of different types of makeup applicators adjacent said base portion; and
a motor for selectively rotating a makeup applicator that is mounted, via said first coupling assembly, adjacent said base portion; and
(B) a first makeup applicator cup, comprising:
a substantially cylindrical applicator body portion comprising:
a top face;
a bottom face; and
at least one finger grip extending radially outward from an outer surface of said applicator body portion adjacent said top face, wherein said applicator body portion defines a substantially cylindrical applicator-receiving recess adjacent said top face;
a second coupling assembly adjacent said bottom face configured for cooperating with said first coupling assembly to maintain said first makeup applicator cup adjacent said base portion of said motorized applicator support; and
a plurality of bristles disposed at least partially within said applicator-receiving recess, said plurality of bristles being disposed substantially parallel to a central axis of said first makeup applicator cup; wherein
said applicator body portion is configured to maintain said plurality of bristles at least partially within said applicator-receiving recess;
said motor is configured to rotate said first makeup applicator cup with respect to said base portion about said central axis when said first makeup applicator cup is coupled adjacent said motorized applicator support;
said motorized applicator support is configured to enable said user to use said motorized applicator support and said first makeup applicator cup, to rotationally apply a first cosmetic to a first portion of said user's body; and
said at least one finger grip is configured to enable said user to selectively couple said first makeup applicator cup adjacent said base of said motorized applicator support substantially without touching said plurality of bristles.

11. The motorized makeup applicator of claim 10, further comprising:
a second makeup applicator, comprising:
a substantially cylindrical second applicator body portion comprising:
a second top face; and
a second bottom face, wherein said second applicator body portion defines a substantially cylindrical second applicator-receiving recess adjacent said second top face;
a third coupling assembly adjacent said second bottom face configured for cooperating with said first coupling assembly to maintain said second makeup applicator adjacent said base portion of said motorized applicator support; and
at least one second applicator disposed at least partially within said second applicator-receiving recess, wherein:
said motor is configured to rotate said second makeup applicator with respect to said base portion about said central axis when said second makeup applicator is coupled adjacent said motorized applicator support.

12. The motorized makeup applicator of claim 10, wherein:
said base portion of said motorized applicator support defines a substantially circular recess having a diameter that is substantially similar to a diameter of said applicator body portion;
said at least one finger grip extends substantially around an entire circumference of said outer surface of said applicator body portion;
said applicator body portion is disposed at least partially within said recess when said first makeup applicator cup is coupled adjacent said motorized applicator support; and
a lower portion of said at least one finger grip is substantially in contact with an upper surface of said base portion of said motorized applicator support while said applicator body portion is disposed at least partially within said recess.

* * * * *